US011458587B2

(12) United States Patent
Lin et al.

(10) Patent No.: US 11,458,587 B2
(45) **Date of Patent: *Oct. 4, 2022**

(54) CARRIER HEAD HAVING RETAINER RING, POLISHING SYSTEM INCLUDING THE CARRIER HEAD AND METHOD OF USING THE POLISHING SYSTEM

(71) Applicant: Taiwan Semiconductor Manufacturing Co., Ltd., Hsin-Chu (TW)

(72) Inventors: Chang-Sheng Lin, Baoshan Township (TW); Hsin-Hsien Lu, Hsinchu (TW)

(73) Assignee: Taiwan Semiconductor Manufacturing Company, Ltd., Hsinchu (TW)

( * ) Notice: Subject to any disclaimer, the term of this patent is extended or adjusted under 35 U.S.C. 154(b) by 637 days.

This patent is subject to a terminal disclaimer.

(21) Appl. No.: 16/515,300

(22) Filed: Jul. 18, 2019

(65) Prior Publication Data

US 2019/0358767 A1 Nov. 28, 2019

Related U.S. Application Data

(62) Division of application No. 15/459,192, filed on Mar. 15, 2017, now Pat. No. 10,377,013, which is a (Continued)

(51) Int. Cl.
*B24B 37/30* (2012.01)
*B24B 37/32* (2012.01)
(Continued)

(52) U.S. Cl.
CPC ..... *B24B 37/042* (2013.01); *B24B 37/105* (2013.01); *B24B 37/20* (2013.01); *B24B 37/30* (2013.01); *B24B 37/32* (2013.01)

(58) Field of Classification Search
CPC ..... B24B 37/042; B24B 37/105; B24B 37/20; B24B 37/30; B24B 37/32
(Continued)

(56) References Cited

U.S. PATENT DOCUMENTS 5,398,459 A * 3/1995 Okumura ..... B24B 37/30 451/286
6,241,591 B1 * 6/2001 Jackson ..... B24B 37/32 451/287

(Continued)

OTHER PUBLICATIONS

Non-Final Office Action dated Dec. 30, 2015 in connection with U.S. Appl. No. 14/134,091.

(Continued)

*Primary Examiner* — Eileen P Morgan
(74) *Attorney, Agent, or Firm* — Eschweiler & Potashnik, LLC

(57) ABSTRACT

Some embodiments relate to a carrier head. The carrier head includes a housing configured to enclose a wafer, wherein the housing includes a retaining ring recess configured to circumferentially surround the wafer. A retaining ring, which includes a first ring-shaped layer and a second ring-shaped layer, is disposed in the retaining ring recess. The second ring-shaped layer is disposed deeper in the retaining ring recess than the first ring-shaped layer and separates the first ring-shaped layer from a bottom of the retaining ring recess. A hardness of the second ring-shaped layer is less than a hardness of the first ring-shaped layer.

20 Claims, 3 Drawing Sheets

Related U.S. Application Data division of application No. 14/134,091, filed on Dec. 19, 2013, now Pat. No. 9,597,771.

(51) Int. Cl.
*B24B 37/04* (2012.01)
*B24B 37/10* (2012.01)
*B24B 37/20* (2012.01)

(58) Field of Classification Search
USPC ..... 451/41, 285, 287, 397, 398
See application file for complete search history.

(56) References Cited

U.S. PATENT DOCUMENTS 6,267,655 B1 * 7/2001 Weldon ..... B24B 37/32 451/307
6,277,008 B1 * 8/2001 Masuta ..... B24B 37/32 451/286
6,390,908 B1 * 5/2002 Chen ..... B24B 49/12 451/41
6,447,368 B1 * 9/2002 Fruitman ..... B24B 49/04 451/287
8,998,676 B2 * 4/2015 Chen ..... B24B 7/00 451/28
2005/0215181 A1 * 9/2005 Wilkinson ..... B23H 5/08 451/287
2006/0128286 A1 * 6/2006 Nabeya ..... B24B 49/16 451/287
2007/0224864 A1 * 9/2007 Burns ..... B24B 37/32 439/164
2008/0051011 A1 * 2/2008 Moloney ..... B24B 37/32 451/41
2008/0146123 A1 * 6/2008 Torii ..... B24B 37/32 451/64
2010/0112914 A1 * 5/2010 Marohl ..... B24B 37/32 451/364
2011/0065368 A1 * 3/2011 Sather ..... B24B 37/32 451/385
2011/0092142 A1 * 4/2011 Frank, Jr. ..... B24B 37/32 451/460
2012/0088366 A1 * 4/2012 Kalenian ..... B24B 37/32 438/692
2013/0035022 A1 * 2/2013 Paik ..... B24B 37/32 451/364
2014/0134929 A1 * 5/2014 Lien ..... B24B 37/32 451/286
2015/0111467 A1 * 4/2015 Lin ..... B24B 37/005 451/1
2015/0209930 A1 * 7/2015 Chen ..... B24B 37/32 451/364
2015/0283668 A1 * 10/2015 Frank, Jr. ..... B24B 37/32 156/345.14

OTHER PUBLICATIONS

Final Office Action dated Apr. 7, 2016 in connection with U.S. Appl. No. 14/134,091.
Non-Final Office Action dated Jul. 15, 2016 in connection with U.S. Appl. No. 14/134,091.
Notice of Allowance dated Nov. 8, 2016 in connection with U.S. Appl. No. 14/134,091.
Non-Final Office Action dated Apr. 19, 2017 for U.S. Appl. No. 15/459,192.
Final Office Action dated Jul. 28, 2017 for U.S. Appl. No. 15/459,192.
Notice of Allowance dated May 13, 2019 for U.S. Appl. No. 15/459,192.
Supplemental Notice of Allowance dated Jun. 11, 2019 for U.S. Appl. No. 15/459,192.

* cited by examiner

CARRIER HEAD HAVING RETAINER RING, POLISHING SYSTEM INCLUDING THE CARRIER HEAD AND METHOD OF USING THE POLISHING SYSTEM

REFERENCE TO RELATED APPLICATIONS

This application is a Divisional of U.S. application Ser. No. 15/459,192, filed on Mar. 15, 2017, which is a Divisional of U.S. application Ser. No. 14/134,091, filed on Dec. 19, 2013 (now U.S. Pat. No. 9,597,771, issued on Mar. 21, 2017). The contents of the above-referenced Patent Applications are hereby incorporated by reference in their entirety.

BACKGROUND

Polishing systems are used to remove material from a wafer. A polishing system includes a carrier head which presses the wafer against a polishing pad. The polishing pad or the carrier head rotate relative to each other which results in material being removed from the wafer. In some instances, a slurry compound is applied to the polishing pad to assist in material removal.

The carrier head includes a retainer ring which is positioned to help prevent the wafer from moving during the polishing process. The retainer ring is also pressed against the polish pad during the polishing operation. As the carrier head or polishing pad rotate, a portion of the polishing pad which is contacted by the retainer ring is also used to remove material from the wafer.

BRIEF DESCRIPTION OF THE DRAWINGS

One or more embodiments are illustrated by way of example, and not by limitation, in the figures of the accompanying drawings, wherein elements having the same reference numeral designations represent like elements throughout. It is emphasized that, in accordance with standard practice in the industry various features may not be drawn to scale and are used for illustration purposes only. In fact, the dimensions of the various features in the drawings may be arbitrarily increased or reduced for clarity of discussion. The figures of the present disclosure, incorporated herein by reference, include the following.

DETAILED DESCRIPTION

The following disclosure provides many different embodiments, or examples, for implementing different features of the invention. Specific examples of components and arrangements are described below to simplify the present disclosure. These are examples and are not intended to be limiting.

Figure 1:
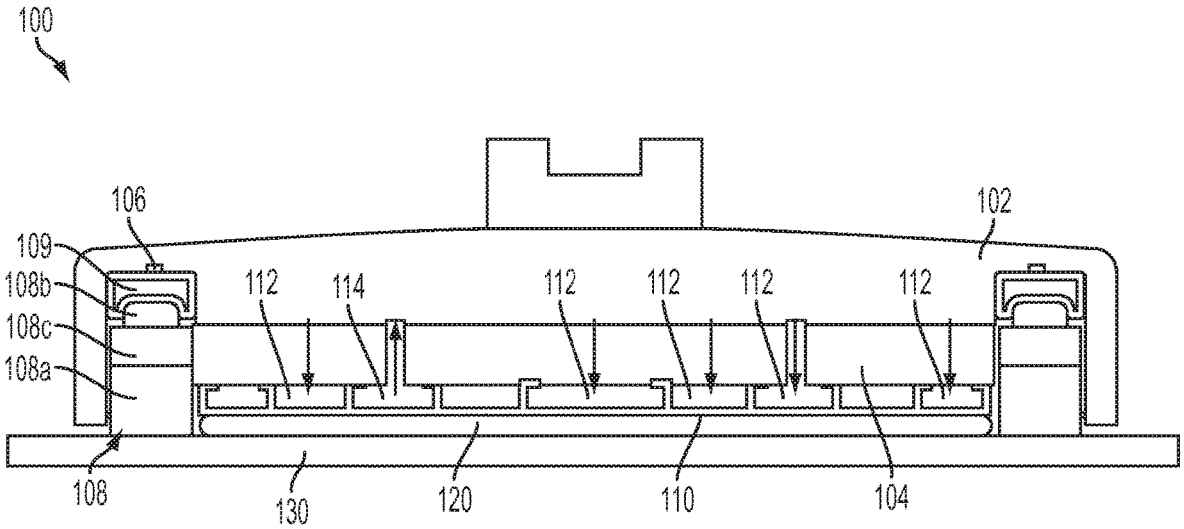
FIG. 1 is a cross sectional view of a carrier head in accordance with one or more embodiments.

FIG. 1 is a cross sectional view of a carrier head 100 in accordance with one or more embodiments. Carrier head 100 includes a housing 102 which is configured to enclose a membrane support 104. A retaining ring recess 106 is positioned in housing 102 around membrane support 104. A retaining ring 108 is accommodated by retaining ring recess 106. Retaining ring 108 includes a top pad portion 108*a* and a sub pad portion 108*b*. In the embodiment of FIG. 1, retaining ring 108 is a multi-layer structure and includes an intermediate pad portion 108*c*. In some embodiments, intermediate pad portion 108*c* is omitted. A retaining ring cushion 109 is also positioned in retaining ring recess 106 between retaining ring 108 and an upper portion of housing 102. A flexible membrane 110 is secured to membrane support 104. Flexible membrane 110 is used to provide a flat surface for securing a wafer 120 to carrier head 100.

Positive pressure is provided to a backside surface of flexible membrane 110 through ports 112 in order to help maintain a flat surface for supporting wafer 120 and to evenly distribute pressure applied to the wafer. A vacuum is able to be applied to the back surface of flexible membrane 110 through port 114 in order to help remove wafer 120 from carrier head 100. Wafer 120 is secured in carrier head 100 such that retaining ring 108 surrounds the wafer. An inner surface of wafer 120 is in contact with flexible membrane 110. An outer surface of wafer 120 is positioned to contact a polishing pad 130. Polishing pad 130 is used to remove material from wafer 120. During operation, retaining ring 108 also contacts polishing pad 130.

Housing 102 is configured to hold wafer 120 against polishing pad 130. Housing 102 is capable of moving in a direction perpendicular to a polishing surface of polishing pad 130 in order to adjust a pressure applied to wafer 110 during the polishing process. A separation distance between housing 102 and polishing pad 130 is maintained during the polishing process to avoid distortion or damage to the polishing pad. Housing 102 includes a material having sufficient mechanical strength to withstand the pressure exerted during the polishing process. Housing 102 has a diameter sufficiently large to enclose wafer 110 with retainer ring 108 surrounding the wafer. Housing 102 includes retaining ring recess 106 in a periphery region to accommodate retaining ring 108. In some embodiments, housing 102 is rotatable in a plane parallel to polishing pad 130. In some embodiments, housing 102 is pivotable about an axis perpendicular to the polishing surface of polishing pad 130.

Membrane support 104 is positioned to provide support for membrane 110 during the polishing process. In some embodiments, membrane support 104 includes openings therein in communication with ports 112 and 114. In some embodiments, membrane support is solid. In some embodiments, membrane support 104 is a substantially rigid material, such as a metal, a dielectric material or another suitable material. In some embodiments, membrane support 104 is omitted and housing 102 directly provides support for membrane 110.

Retaining ring recess 106 is located in housing 102. Retaining ring recess 106 is used to secure retaining ring 108 to housing 102. In some embodiments, retaining ring recess 106 includes a securing element to hold retaining ring 108 in place during the polishing process. In some embodiments, the securing element includes a detent, a protrusion, a spring-biased element, a recess or another suitable element. In some embodiments, a sidewall of retaining ring recess 106 is aligned with an edge of membrane support 104. In some embodiments, retaining ring recess 106 is offset with respect to membrane support 104. In some embodiments, carrier head 100 includes a plurality of retaining ring recesses.

Retaining ring 108 is positioned within retaining ring recess 106. Retaining ring 108 is used to reduce lateral movement of wafer 120 during the polishing process. In order to reduce lateral movement of wafer 120, carrier head 100 presses retaining ring 108 against polishing pad 130. Retaining ring 108 includes a top pad portion 108*a* and a sub pad portion 108*b*. In some embodiments, sub pad portion 108*b* is omitted. In embodiments which include sub pad portion 108*b*, sub pad portion 108*b* has a hardness less than a hardness of top pad portion 108*a*. In some embodiments, a surface of top pad portion 108*a* which is positioned to contact polishing pad 130 is textured to reduce a surface area of retaining ring 108 in contact with the polishing pad.

Retaining ring 108 has a hardness ranging from about 5 shore A to about 80 shore D. Shore durometer is a hardness measurement unit as well as the term used to refer to the measuring tool. Shore durometer is used to measure hardness of polymers, elastomers and rubbers. Shore durometers are measured on several scales. The shore A scale is used for softer materials, and the shore D scale is used for harder materials. If the hardness of retaining ring 108 is too high, retaining ring 108 will distort or damage polishing pad 130 during the polishing process, in some embodiments. If the hardness of retaining ring 108 is too low, a risk of retaining ring 108 becoming stretched or a portion of the retaining ring being pressed between wafer 120 and polishing pad 130 is increased, in some embodiments.

In some embodiments, retaining ring 108 includes polyvinyl alcohol (PVA), polyvinyl chloride (PVC), polyurethane (PU), polyethylene terephthalate (PET), polyethylene (PE), polystyrene (PS), polypropylene (PP), polycarbonate (PC), or another suitable material. In some embodiments, retaining ring 108 is a non-porous material. In some embodiments, retaining ring 108 is a porous material. In some embodiments, a pore size in retaining ring 108 ranges from about 0.5 microns (μm) to about 100 μm. If the pore size is too great, retaining ring 108 a slurry compound used during the polishing process will be trapped in the retaining ring, in some embodiments. If the pore size is too small, a hardness of retaining ring 108 is too high, in some embodiments. In some embodiments, a porosity of retaining ring 108 is equal to or less than about 70%. If the porosity is too great, a risk of pieces of retaining ring 108 breaking off during the polishing process increases, in some embodiments.

In some embodiments, a compressibility of retaining ring 108 ranges from about 1% to about 50%. Compressibility is a measure of a change in volume of retaining ring 108 at a native state to a volume during the polishing process. In some embodiments, compressibility is determined based on an equation $C=(T_1-T_2)/T_1\times100$, where C is compressibility, $T_1$ is a thickness of a sample experiencing a compressive stress of 300 g/cm$^2$, and $T_2$ is a thickness of the sample experiencing a compressive stress of 1800 g/cm$^2$. The thickness measurements are made using constant compressive stress at a temperature of about 25° C.

In comparison with other approaches which include a harder retaining ring, carrier head 100 is able to polish a wafer having a more uniform thickness profile. In other approaches, retaining rings made of polyetheretherketone (PEEK) or polyphenylene sulfide (PPS) have a hardness ranging from 95 Rockwell M to 107 Rockwell M. Rockwell M is a different hardness measurement unit from shore durometer. Rockwell M is used for measuring harder materials than shore durometers. Hard retaining rings which are pressed against a polishing pad during the polishing process have an increased risk of damaging or distorting the polishing pad. During the polishing operation, carrier head 100 is moved laterally across polishing pad 130. As a result of this lateral movement, a portion of polishing pad 130 contacted by retaining ring 108 is also contacted by wafer 120. Distorts or damage introduced to polishing pad 130 due to retaining ring 108 impacts uniformity of material removal during the polishing process. Non-uniform material removal from wafer 120 results in the wafer having a thickness variation across a polished surface of the wafer which contacts polishing pad 130. Non-uniform material removal is most pronounced in an edge region of a wafer during to the increased pressure on the wafer edge in comparison with a center of the wafer. Non-uniformity in the wafer thickness impacts an ability to form additional layers on the polished surface as well as production yield.

In some embodiments, an edge to center thickness variation for wafer 120 using carrier head 100 having retaining ring 108 is less than or equal to about 10%. In some embodiments, an edge to mean thickness variation for wafer 120 using carrier head 100 having retaining ring 108 is less than or equal to about 10%. The reduced thickness variation made possible by the use of retaining ring 108 helps to increase a usable area of wafer 120 and to increase production yield. In some embodiments, a uniformity of wafer 120 is calculated based on an equation Uniformity=Average/σ× 100%, wherein average is the average thickness of wafer 120 across the wafer, and σ is the standard deviation of thickness measurements across the wafer.

In some embodiments, top pad portion 108*a* is a multi-layered structure. A layer of top pad portion 108*a* farthest from polishing pad 130 has a lowest hardness of the multi-layered structure.

Retaining ring cushion 109 is located in retaining ring recess 106. Retaining ring cushion 109 is positioned between a surface of retaining ring 108 farthest from polishing pad 130 and housing 102. Retaining ring cushion 109 helps to absorb some of the pressure applied to retaining ring during the polishing process. In some embodiments, retaining ring cushion 109 includes a flexible element enclosing a volume of a fluid. In some embodiments, retaining ring cushion 109 includes a flexible solid material.

Membrane 110 is used to increase uniformity of the pressure applied to wafer 120 during the polishing process. In some embodiments, the membrane 110 is formed of a flexible and elastic fluid-impermeable material. In some embodiments, membrane 110 includes at least one of neoprene, chloroprene, ethylene propylene rubber, silicone, or other suitable flexible materials.

Ports 112 are used to provide positive pressure to a surface of membrane 110 opposite wafer 120. In some embodiments, ports 112 communicate with holes in membrane support 104. In some embodiments, ports 112 communicate with openings in housing 102. In some embodiments, ports 112 are integral with membrane 110. In some embodiments, ports 112 are formed as a separate element to form a passage which is in fluid communication with membrane 110. The positive pressure provided through ports 112 helps to provide uniform pressure to wafer 120 during the polishing process. In some embodiments, a single port 112 is used to provide the positive pressure.

Port 114 is used to provide a negative pressure to the surface of membrane 110 opposite wafer 120. In some embodiments, port 114 communicates with a hole in membrane support 104. In some embodiments, port 114 communicates with an opening in housing 102. In some embodiments, port 114 is integral with membrane 110. In some embodiments, port 114 is formed as a separate element to form a passage which is in fluid communication with membrane 110. The negative pressure provided through port 114 helps to remove wafer 120 from carrier head 100 following the polishing process. In some embodiments, a plurality of ports 114 is used to provide the positive pressure.

Wafer 120 is configured to be supported in carrier head 100. In some embodiments, wafer 120 contains active devices. In some embodiments, wafer 120 contains passive devices. In some embodiments, wafer 120 is a raw unprocessed wafer. In some embodiments, carrier head 100 is configured to move wafer 120 relative to polishing pad 130.

Polishing pad 130 is configured to remove material from wafer 120. In some embodiments, a slurry compound is present on polishing pad 130. In some embodiments, polishing pad 130 is movable relative to wafer 120.

In comparison with other approaches, carrier head 100 including retaining ring 108 is able to produce a more uniform wafer following a polishing process. The more uniform wafer enhances an ability of forming additional layers on the wafer and increasing production yield. In addition, the use of retaining ring 108 which does not include sub pad portion 108*b* will also decrease production cost by reducing an amount of purchased material.

Figure 2:
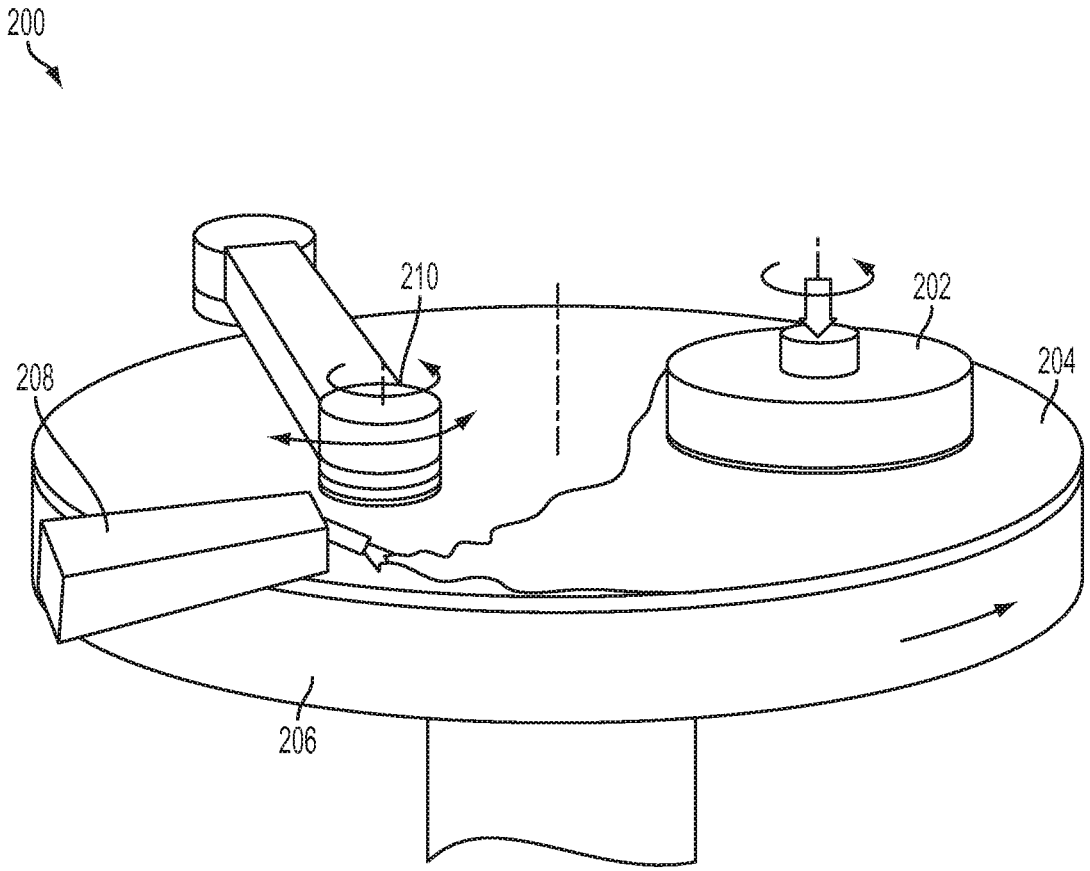
FIG. 2 is a perspective view of a polishing system in accordance with one or more embodiments.

FIG. 2 is a perspective view of a polishing system 200 in accordance with one or more embodiments. In some embodiments, the polishing system 200 is usable for chemical mechanical polishing (CMP). Polishing system 200 includes a carrier head 202 which is configured to support a wafer to be polished. Carrier head 202 is configured to press the wafer against a polishing pad 204 which is supported by a platen 206. A slurry line 208 is disposed adjacent a top surface of polishing pad 204. Slurry is supplied onto the polishing pad 204 through slurry line 208. A pad reconditioning arm 210 is positioned to help recondition polishing pad 204.

Carrier head 202 is supports a wafer to be polished. In some embodiments, carrier head 202 is similar to carrier head 100 (FIG. 1). Carrier head 202 includes a retaining ring positioned to reduce the risk of lateral movement of the wafer during the polishing process. The retaining ring has a hardness ranging from about 5 shore A to about 80 shore D. In some embodiments, the retaining ring includes PVA, PVC, PU, PET, PE, PS, PP, PC, or another suitable material. In some embodiments, the retaining ring is a non-porous material. In some embodiments, the retaining ring is a porous material. In some embodiments, a pore size in the retaining ring ranges from about 0.5 μm to about 100 μm. In some embodiments, a porosity of the retaining ring is equal to or less than about 70%. In some embodiments, a compressibility of the retaining ring ranges from about 1% to about 50%.

Carrier head 202 is able to move in a direction perpendicular to a top surface of polishing pad 204. Moving carrier head 202 perpendicular to polishing pad 204 facilitates adjusting the pressure applied to the wafer and the retaining ring during the polishing process. A pressure applied to the wafer is a factor in determining a rate of material removal from the wafer. A pressure applied to the retaining ring is a factor in the risk that polishing pad 204 will be damaged or distorted by the retaining ring. A softer retaining ring is able to withstand a higher pressure with a reduced risk of damaging or distorting polishing pad 204.

In some embodiments, carrier head 202 is configured to rotate with respect to polishing pad 204. In some embodiments, carrier head 202 is configured to translate with respect to polishing pad 204. In some embodiments, a rate of movement of carrier head 202 is constant during the polishing process. In some embodiments, the rate of movement of carrier head 202 is variable during the polishing process. In some embodiments, carrier head 202 is configured to remain stationary during the polishing process.

Polishing pad 204 is positioned to contact the retaining ring and the wafer during the polishing process. A polishing surface of polishing pad 204 is configured to remove material from the wafer during the polishing process. In some embodiments, polishing pad 204 is polishing pad 130 (FIG. 1).

Platen 206 supports polishing pad 204. In some embodiments, platen 206 is configured to rotate, causing polishing pad 204 to rotate with respect to carrier head 202. In some embodiments, a direction of rotation of platen 206 is opposite to a direction of rotation of carrier head 202. In some embodiments, platen 206 has a rate of rotation equal to a rate of rotation of carrier head 202. In some embodiments, platen 206 has a different rate of rotation from the rate of rotation of carrier head 202.

Slurry line 208 is configured to deliver a slurry compound to polishing pad 204 during the polishing operation. The slurry compound helps to remove material from the wafer. A composition of the slurry compound is selected based on the material being removed from the wafer. In some embodiments, a flow rate of the slurry from slurry line 208 is constant during the polishing process. In some embodiments, the flow rate of the slurry from slurry line 208 is variable.

Pad reconditioning arm 210 is configured to remove debris from polishing pad 204 during the polishing process. Pad reconditioning arm 210 is also configured to roughen the polishing surface of polishing pad 204. During the polishing process, the polishing surface of polishing pad 204 becomes progressively smoother due to the pressure applied by the wafer and the retaining ring. Pad reconditioning arm 210 is used to help restore a roughness of the polishing surface to maintain the material removing capabilities of polishing pad 204. In some embodiments, pad reconditioning arm 210 is configured to rotate with respect to polishing pad 204. In some embodiments, pad reconditioning arm 210 is configured to translate with respect to polishing pad 204. In some embodiments, a rate of movement of pad reconditioning arm 210 is constant. In some embodiments, the rate of movement of pad reconditioning arm 210 is variable.

In comparison with other approaches which include a harder retaining ring, polishing system 200 is able to polish a wafer having a more uniform thickness profile. In some embodiments, a wafer polished using polishing system 200 had an edge to center thickness variation less than or equal to about 10%. In some embodiments, a wafer polishing using polishing system 200 had an edge to mean thickness variation less than or equal to about 10%. The low thickness variation in the wafer helps to enhance an ability to form additional layers on the wafer and to increase production yield.

Figure 3:
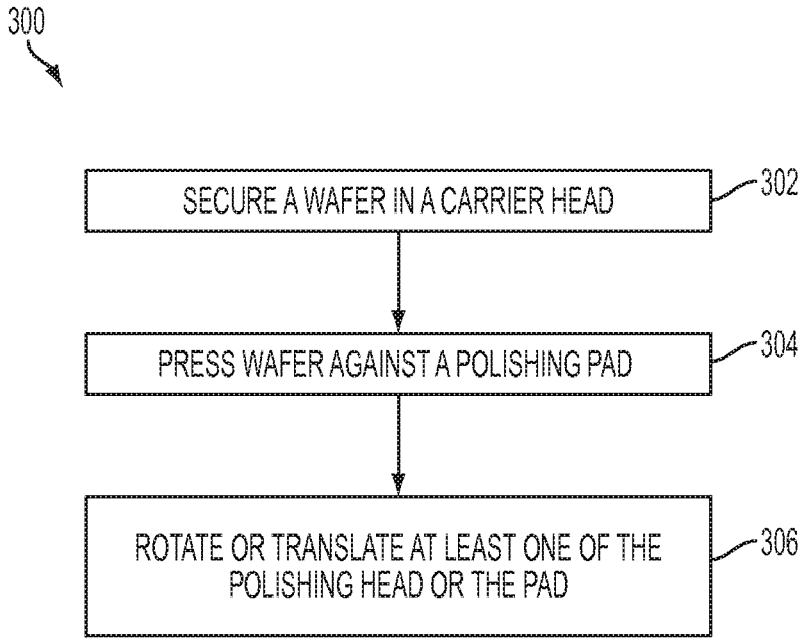
FIG. 3 is a flow chart of a method of using a polishing system in accordance with one or more embodiments.

FIG. 3 is a flow chart of a method 300 of using a polishing system in accordance with one or more embodiments. Method 300 begins with operation 302 in which a wafer, e.g., wafer 120 (FIG. 1), is secured in a carrier head, e.g., carrier head 100 or 202 (FIG. 2). The wafer is secured in the carrier head at least partially by a retaining ring. The retaining ring has a hardness ranging from about 5 shore A to about 80 shore D. In some embodiments, the retaining ring includes PVA, PVC, PU, PET, PE, PS, PP, PC, or another suitable material. In some embodiments, the retaining ring is a non-porous material. In some embodiments, the retaining ring is a porous material. In some embodiments, a pore size in the retaining ring ranges from about 0.5 μm to about 100 μm. In some embodiments, a porosity of the retaining ring is equal to or less than about 70%. In some embodiments, a compressibility of the retaining ring ranges from about 1% to about 50%. In some embodiments, the wafer is also partially secured in the carrier table using a membrane, e.g., membrane 110 (FIG. 1). In some embodiments, a vacuum is used to help secure the wafer in the carrier head.

Method 300 continues with operation 304 in which the wafer is pressed against a polishing pad, e.g., polishing pad 130 (FIG. 1) or 204 (FIG. 2). A pressure with which the wafer is pressed against the polishing pad is determined by moving the carrier head in a direction perpendicular to a surface of the polishing pad. The retaining ring in the carrier head is also pressed against the polishing pad during operation 304.

In operation 306, at least one of the carrier head or the polishing pad is either rotated or translated. In some embodiments, the carrier head rotated with respect to the polishing pad. In some embodiments, the carrier head is translated with respect to the polishing pad. In some embodiments, a rate of movement of the carrier head is constant during operation 306. In some embodiments, the rate of movement of the carrier head is variable during operation 306. In some embodiments, the carrier head remains stationary during operation 306.

In some embodiments, the polishing pad rotates with respect to the carrier head. In some embodiments, a direction of rotation of the polishing pad is opposite to a direction of rotation of the carrier head. In some embodiments, the polishing pad has a rate of rotation equal to a rate of rotation of the carrier head. In some embodiments, the polishing pad has a different rate of rotation from the rate of rotation of the carrier head.

One of ordinary skill in the art would recognize that additional operations are able to be included in method 300. In some embodiments, the additional operations include supplying a slurry to the polishing pad, reconditioning the polishing pad, monitoring and adjusting a pressure applied to the wafer during method 300 or other suitable operations. In some embodiments, an order of operations of method 300 is adjusted. For example, operation 306 is performed prior to operation 304, in some embodiments.

One aspect of this description relates to a carrier head. The carrier head includes a housing configured to enclose a wafer, and a retaining ring recess in the housing. The carrier head further includes a retaining ring positioned in the retaining ring recess. The retaining ring configured to surround the wafer, wherein the retaining ring has a hardness ranging from about 5 shore A to about 80 shore D.

Another aspect of this description relates to a polishing system. The polishing system includes a carrier head and a polishing pad. The carrier head includes a housing configured to enclose a wafer, and a retaining ring recess in the housing. The carrier head further includes a retaining ring positioned in the retaining ring recess. The retaining ring configured to surround the wafer, wherein comprises at least one of polyvinyl alcohol (PVA), polyvinyl chloride (PVC), polyurethane (PU), polyethylene terephthalate (PET), polyethylene (PE), polystyrene (PS), polypropylene (PP), or polycarbonate (PC). The polishing pad is configured to contact the retaining ring and the wafer and to remove material from the wafer. At least one of the polishing pad or the carrier head are configured to move relative to the other.

Still another aspect of this description relates to a method of using a polishing system. The method includes securing a wafer in a carrier head. The carrier head includes a housing enclosing the wafer, a retaining ring recess in the housing, and a retaining ring positioned in the retaining ring recess. The retaining ring surrounding the wafer, wherein the retaining ring has a hardness ranging from about 5 shore A to about 80 shore D. The method further includes pressing the wafer against a polishing pad, and moving at least one of the carrier head or the polishing pad relative to the other.

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon be limited only by the definition contained in the appended claims and equivalents thereof.

What is claimed is:

1. A carrier head comprising:

a housing configured to enclose a wafer, wherein the housing includes a retaining ring recess configured to circumferentially surround the wafer; and a retaining ring, which includes a first ring-shaped layer and a second ring-shaped layer, disposed in the retaining ring recess, the second ring-shaped layer disposed deeper in the retaining ring recess than the first ring-shaped layer and separating the first ring-shaped layer from a bottom of the retaining ring recess, wherein a hardness of the second ring-shaped layer is less than a hardness of the first ring-shaped layer.

2. The carrier head of claim 1, wherein the retaining ring has a hardness ranging from about 5 shore A to about 80 shore D.

3. The carrier head of claim 1, wherein the retaining ring comprises at least one of polyvinyl alcohol (PVA), polyvinyl chloride (PVC), polyurethane (PU), polyethylene terephthalate (PET), polyethylene (PE), polystyrene (PS), polypropylene (PP), or polycarbonate (PC).

4. The carrier head of claim 1, wherein the retaining ring has a porosity of less than or equal to about 70%.

5. The carrier head of claim 1, wherein the retaining ring is a porous material and has a pore size ranging from about 0.5 microns (μm) to about 100 μm.

6. The carrier head of claim 1, wherein a compressibility of the retaining ring ranges from about 1% to about 50%.

7. The carrier head of claim 1, further comprising a membrane configured to be between the housing and the wafer, wherein the membrane is configured to evenly distribute a pressure across the wafer during a polishing process.

8. A polishing system comprising:

a carrier head, the carrier head comprising:

a housing configured to enclose a wafer, wherein the housing includes a retaining ring recess;

a retaining ring positioned in the retaining ring recess, the retaining ring configured to surround the wafer, the retaining ring comprising:

a top pad portion; and a sub pad portion positioned between the top pad portion and the housing, wherein a hardness of the sub pad portion is less than a hardness of the top pad portion; and a polishing pad configured to contact the top pad portion of the retaining ring and the wafer and to remove material from the wafer, wherein at least one of the polishing pad or the carrier head are configured to move relative to the other.

9. The polishing system of claim 8, wherein the retaining ring has a hardness ranging from about 5 shore A to about 80 shore D.

10. The polishing system of claim 8, wherein the retaining ring has a compressibility ranging from about 1% to about 50%, wherein the compressibility (C) is based on an equation C=(T1−T2)/T1×100, wherein $T_1$ is a first thickness of the retaining ring under a first compressive stress and T2 is a second thickness of the retaining ring under a second compressive stress which is greater than the first compressive stress.

11. The polishing system of claim 8, wherein the retaining ring has a porosity of less than or equal to about 70%.

12. The polishing system of claim 8, wherein the retaining ring is a porous material and has a pore size ranging from about 0.5 microns (μm) to about 100 μm.

13. The polishing system of claim 8, wherein a compressibility of the retaining ring ranges from about 1% to about 50%.

14. The polishing system of claim 8, wherein the carrier head is configured to rotate or translate with respect to the polishing pad.

15. The polishing system of claim 8, wherein the polishing pad is configured to rotate relative to the carrier head.

16. A polishing system comprising:

a carrier head comprising a housing configured to enclose a wafer, wherein the housing includes a retaining ring recess; and a retaining ring disposed in the retaining ring recess, wherein the retaining ring has a compressibility ranging from about 1% to about 50%, wherein the compressibility (C) is based on an equation C=(T1−T2)/T1×100, wherein T1 is a first thickness of the retaining ring under a first compressive stress and T2 is a second thickness of the retaining ring under a second compressive stress which is greater than the first compressive stress.

17. The polishing system of claim 16, wherein the retaining ring comprises:

a top pad portion; and a sub pad portion positioned between the top pad portion and the housing, wherein a hardness of the sub pad portion is less than a hardness of the top pad portion.

18. The polishing system of claim 17, further comprising:

a polishing pad configured to contact the top pad portion of the retaining ring; and wherein the carrier head is configured to press a face of the wafer against the polishing pad, or vice versa, to polish the face of the wafer.

19. The polishing system of claim 16, wherein the second compressive stress is more than twice the first compressive stress.

20. The polishing system of claim 16, wherein the first compressive stress is 300 g/cm$^2$ and the second compressive stress is 1800 g/cm$^2$.

* * * * *